United States Patent [19]

Dorosz et al.

[11] 4,171,672

[45] Oct. 23, 1979

[54] APPARATUS FOR HOLDING WORK IN A SEWING MACHINE

[75] Inventors: Adolph S. Dorosz, Beverly; Edward S. Malecki, Lynn; John F. Martin, South Essex; Herbert Johnson; Francis A. Wickers, both of Beverly, all of Mass.

[73] Assignee: USM Corporation, Farmington, Conn.

[21] Appl. No.: 867,927

[22] Filed: Jan. 9, 1978

[51] Int. Cl.[2] ..... D05B 21/00

[52] U.S. Cl. ..... 112/121.12

[58] Field of Search ..... 112/121.12, 121.11, 112/121.15, 260, 203, 207, 121.29

[56] References Cited

U.S. PATENT DOCUMENTS

| | | | |
|---|---|---|---|
| 2,829,564 | 4/1958 | Onsrud | 112/121.12 X |
| 3,769,924 | 11/1973 | Rogers et al. | 112/121.12 X |
| 3,779,185 | 12/1973 | Sakakura et al. | 112/121.12 |
| 4,006,698 | 2/1977 | Scholl et al. | 112/121.11 |

*Primary Examiner*—H. Hampton Hunter

*Attorney, Agent, or Firm*—William F. White; Richard B. Megley; Vincent A. White

[57] ABSTRACT

A mechanism is provided for holding and securing a workpiece within a sewing machine. The mechanism includes a plurality of clamping elements which may be arranged in different configurations so as to accommodate different sewing patterns. The different arrangements of clamping elements are inserted into a carriage which defines the positions of the clamping elements relative to each other as well as with respect to the bed of the sewing machine.

40 Claims, 14 Drawing Figures

APPARATUS FOR HOLDING WORK IN A SEWING MACHINE

FIELD OF THE INVENTION

This invention relates to mechanisms for holding materials that are to be joined together. In particular, this invention relates to a holding mechanism for materials that are to be sewn together.

BACKGROUND OF THE INVENTION

Operations that involve the joining together of two or more pieces of material often require complex mechanisms for holding the various pieces of material relative to each other. These mechanisms become even more complicated when the pieces of material must be moved while they are being joined together. For instance, in a sewing operation, the pieces of material that are to be joined together must be held securely with respect to each other as they are guided underneath a sewing needle. The pieces of material (hereinafter collectively referred to as the workpiece) are guided underneath the sewing needle in such a manner as to define a series of successive stitching points. The sewing needle enters the workpiece at each of the thus defined stitching points and joins the pieces of material together. Any slippage of the workpiece within the clamping mechanism during the sewing operation will result in an erroneous stitch by the sewing needle. Furthermore, any misregistration of the workpiece when initially clamped will result in subsequent deviations from the predefined stitching points.

Clamping mechanisms which attempt to solve the above problems of work slippage and misregistration are often designed to conform to the shape of a specific sewing pattern that is to be sewn. These clamping mechanisms cannot be utilized to clamp a workpiece for the sewing of a substantially different pattern. On the other hand, clamping mechanisms which do allow for the sewing of substantially different patterns are usually quite complex in design. These latter mechanisms moreover require complicated, time-consuming procedures for inserting, aligning, and clamping the workpiece.

OBJECTS OF THE INVENTION

It is an object of this invention to provide a new and improved mechanism for holding pieces of material in fixed positions relative to each other while they are being joined together.

It is another object of this invention to provide a new and improved mechanism for holding pieces of material in fixed positions relative to each other wherein the pieces of material are easily inserted, aligned and clamped.

It is still another object of this invention to provide a new and improved mechanism for holding various pieces of material relative to each other in different ways so as to allow for the sewing of substantially different sewing patterns.

SUMMARY OF THE INVENTION

To achieve the above objects, a sewing machine is provided with a mechanism that securely holds the workpiece in place during the sewing operation. The mechanism includes a movable carriage which receives a plurality of individually shaped clamping elements. The positions of the so received clamping elements can be adjusted relative to each other by means internal to the carriage. The positions of the clamping elements can, furthermore, be adjusted relative to the bed of the sewing machine. The thus positioned clamping elements comprise upper and lower clamping elements together with a gauge element located therebetween. The gauge element serves to align a workpiece that is to be clamped between the upper and lower clamping elements.

Before inserting and aligning a particular workpiece, the movable carriage is positioned so as to allow the clamping elements to extend out over the edge of the bed of the sewing machine. This outward extension of the clamping elements together with their particular shapes allows a workpiece to be easily inserted and aligned. The clamping elements close over the workpiece once the same has been aligned. The thus closed clamping elements define a clamping configuration which circumscribes the area of the workpiece wherein a particular sewing pattern is to be sewn. These same clamping elements may be turned over and inserted into the movable carriage in an alternative configuration. The alternative configuration defines a substantially different sewing pattern.

BRIEF DESCRIPTION OF THE DRAWINGS

The above and other features of the invention will now be particularly described with reference to the accompanying drawings, in which.

DESCRIPTION OF THE PREFERRED EMBODIMENT

Figure 1:
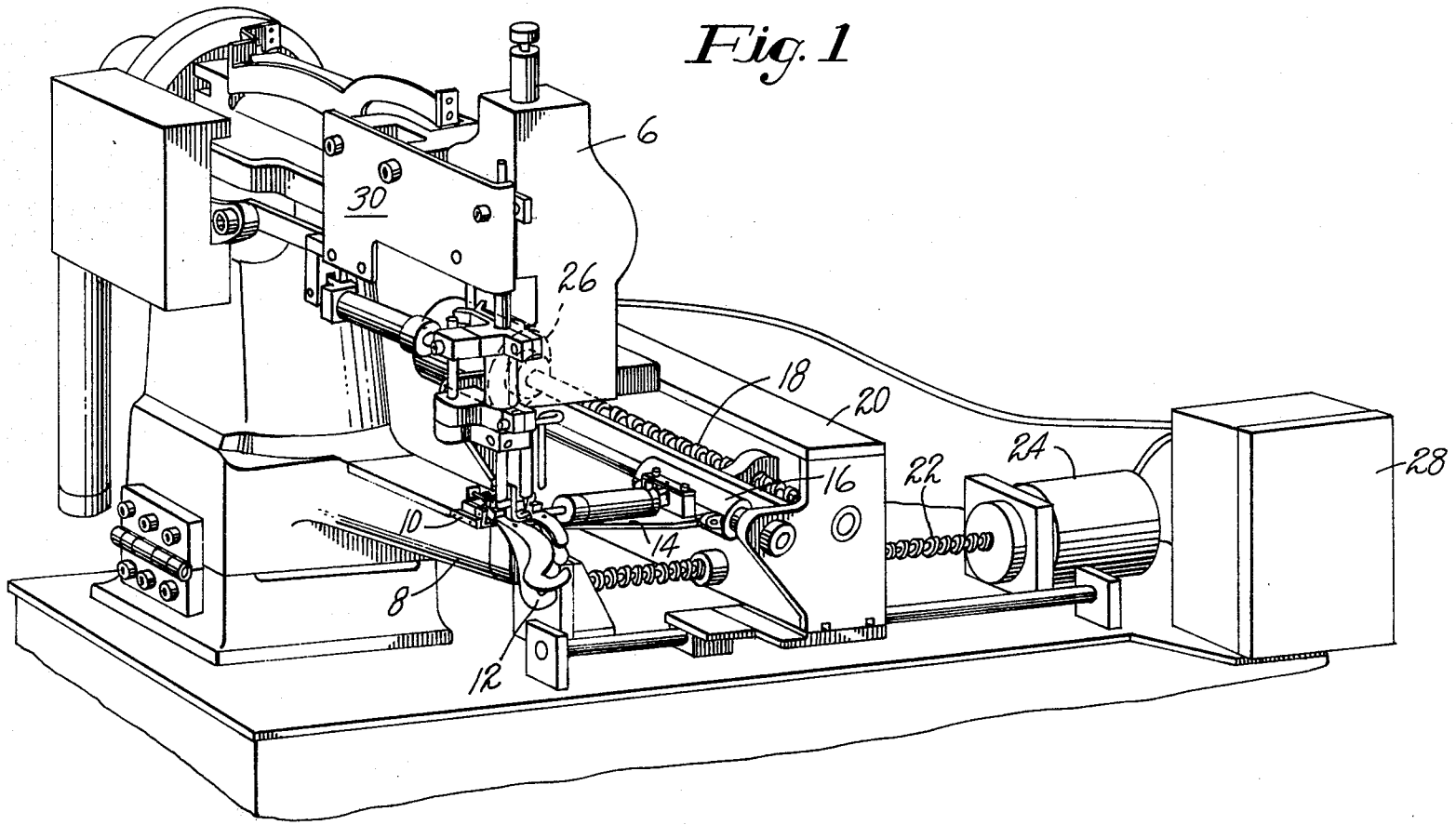
FIG. 1 is a perspective view of a sewing machine having apparatus for holding and moving a workpiece within a sewing area.

Referring to FIG. 1, an automatic sewing machine having a sewing head 6 and a sewing bed 8 is generally illustrated. Resting on the sewing bed 8 is a carriage 10 containing a plurality of clamps 12 which extend out over the edge of the bed 8. the clamps 12 are in an open state preporatory to receiving a workpiece.

The carriage 10 includes an arm 14 which is either rotatably or flexibly connected to a transport 16. The transport 16 is moved forward and backward by a ball screw drive 18. The ball screw drive 18 is mounted within a movable platform 20 which is driven laterally from side to side by a ball screw drive 22. The side to side lateral movement of the platform 20 will hereinafter be referred to as the X direction of movement whereas the forward and backward movement of the transport 16 will be referred to as the Y direction of movement. It is to be appreciated that the X direction of movement of the platform 20 will be superimposed on the Y direction of movement of the transport 16 so as to thereby cause the carriage 14 to move in any desired direction with respect to the sewing head 6.

The amount of X and Y movement is preferably governed by a pair of servo motors associated with each ball screw drive, specifically, a servo motor 24, associated with the ball screw drive 22, defines the amount of movement in the X direction. A servo motor 26 mounted on the backside of the platform 22 defines the amount of movement in the Y direction. The servo motors are driven by a digital control system 28 which generates a train of pulses to each motor indicating the amount of X and Y movement. This is done in timed synchronization with the movement of the sewing needle within the sewing head 6. In this manner, the desired X and Y movements are accomplished so as to not interfere with the movement of the sewing needle through the workpiece. An example of such a digital control system having these capabilities can be found in U.S. application Ser. No. 867,926, entitled "Automatic Stitching Apparatus", filed in the names of A. S. Dorosz, M. F. Fino, J. F. Martin, and R. E. Welcher on Jan. 9, 1978.

Figure 2:
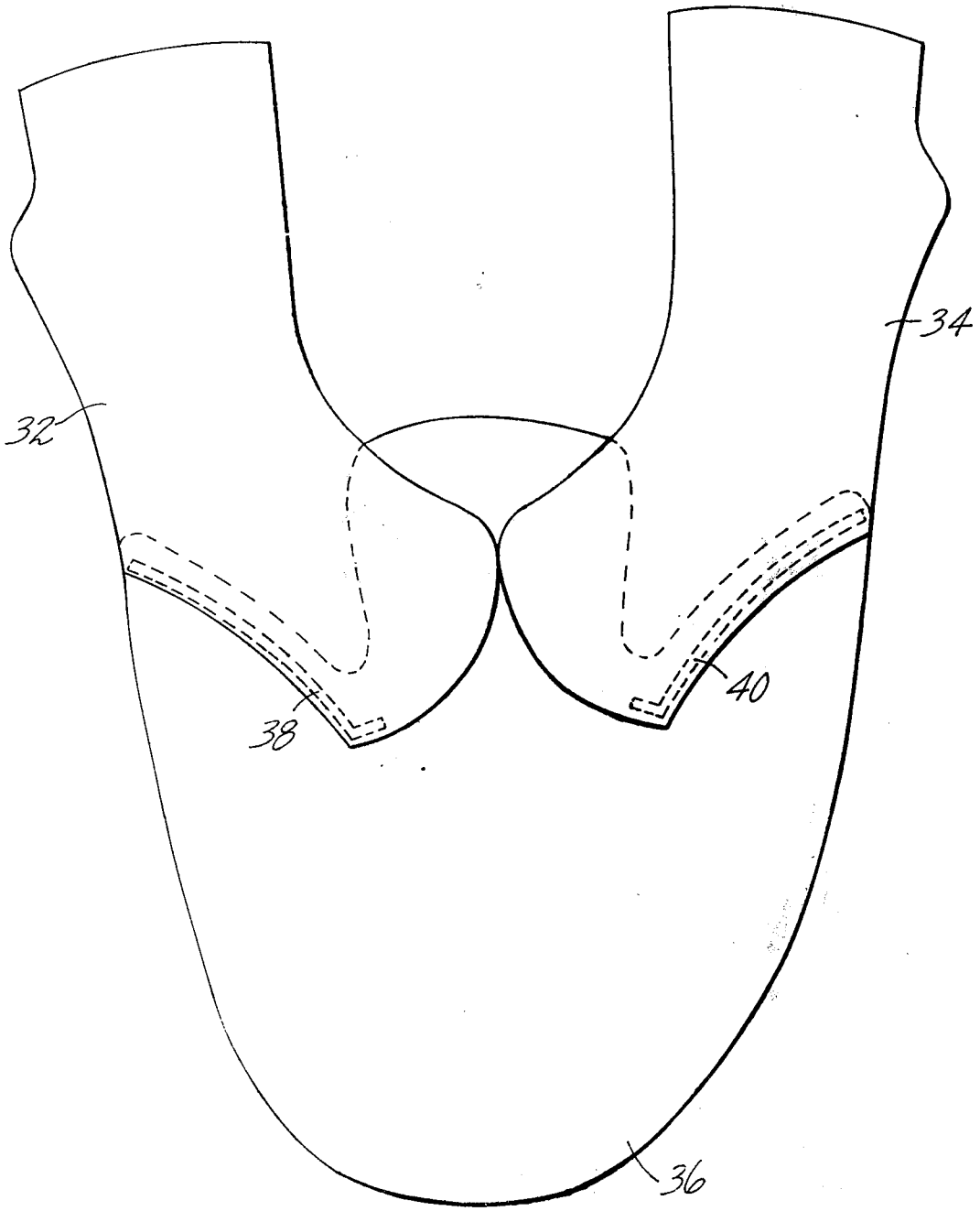
FIG. 2 is a view of an exemplary workpiece which is to be stitched in either of two directions.

Referring now to FIG. 2, an example of a workpiece which is to be stitched by the sewing machine is generally illustrated. The exemplary workpiece of FIG. 2 is illustrative of a sewing operation for a shoe. It is to be appreciated that automatically controlled stitching for other applications is also contemplated by the invention. The workpiece in FIG. 2 consists of a pair of shoe quarter portions 32 and 34 which are to be stitched to a vamp 36. Although not shown, the shoe quarters may have already been joined together to form the rear or heel portion of the shoe. In any event, the particular stitch which is required in each instance to join a shoe quarter to the vamp 36 is that of a vamp stitch. These vamp stitches are denoted as 38 and 40 in FIG. 2. It is to be noted that these stitches are mirror images of each other. In other words, each stitch extends in a direction opposite to the other.

The opposite directional nature of these stitching patterns will be hereinafter referred to by denoting the stitching pattern 38 as "a normal pattern" and the stitching pattern 40 as "the opposite pattern". It is to be appreciated that this referencing is entirely arbitrary insofar as the practice of the invention.

Figure 3A:
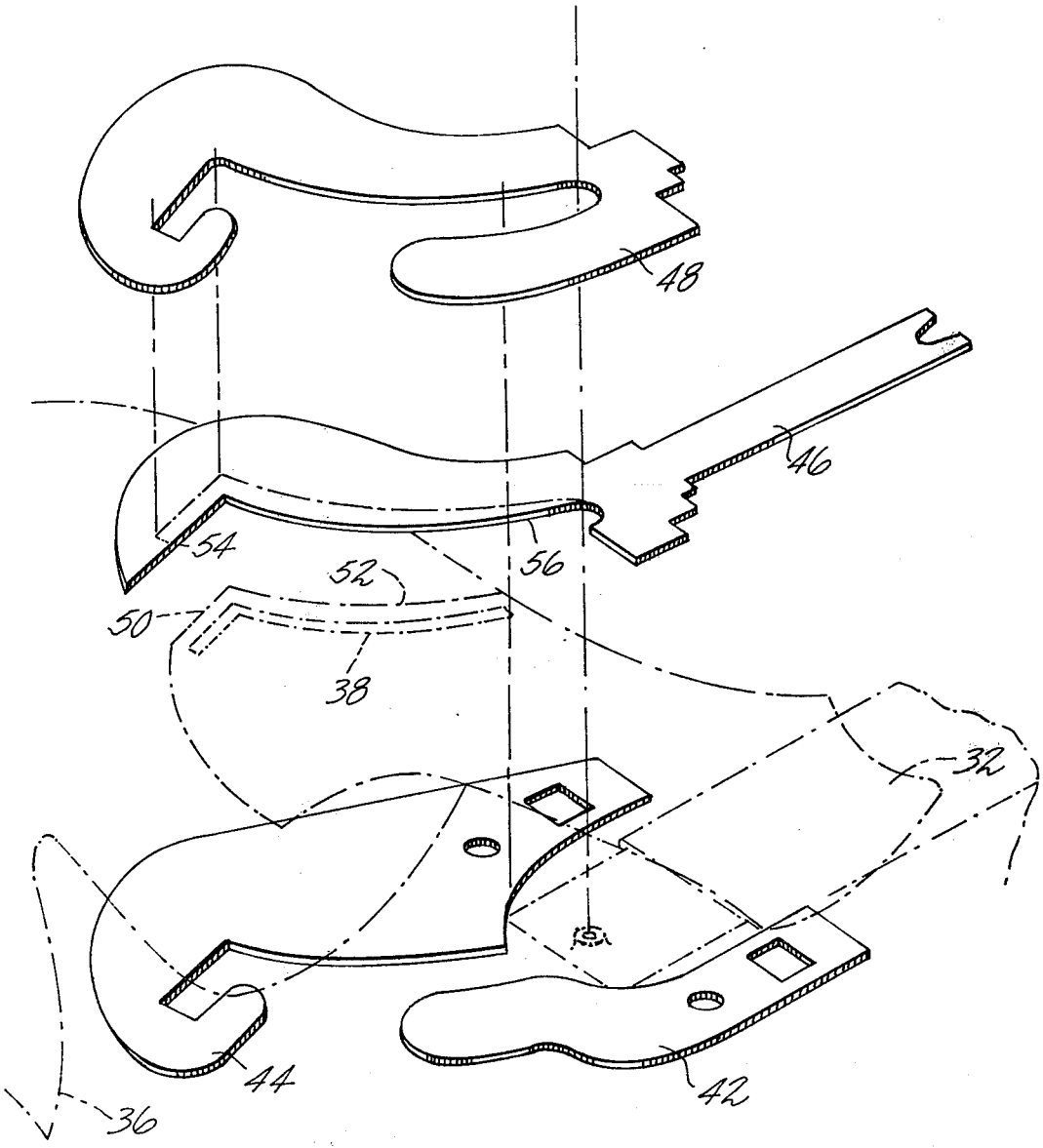
FIG. 3A is an exploded view of the clamp elements used to clamp the workpiece of FIG. 2.

Referring now to FIG. 3A, dotted outlines of the shoe quarter 32 and the shoe vamp 36 are shown relative to a plurality of clamps. The clamps consist of a pair of lower clamps 42 and 44, a gauge 46, and an upper clamp 48. The shoe quarter 32 and the shoe vamp 36 are to be securely held together by these various clamps during the sewing of a normal pattern 38 which is denoted in dotted outline form. The sewing of the normal pattern 38 occurs after the workpiece has been aligned with respect to the gauge 46 and clamped between the upper and lower clamps.

The alignment of the workpiece with respect to the gauge 46 is preceded by an alignment of the shoe quarter 32 relative to the shoe vamp 36. This is preferably accomplished by aligning the edges 50 and 52 of the shoe quarter with respect to a previously inscribed line (not shown) on the shoe vamp 36. The previously inscribed line is merely an outline of the edges 50 and 52 on the vamp 36. The thus aligned pieces of material constitute the workpiece which is to be positioned with respect to the gauge 46. This is accomplished by aligning the edges 50 and 52 of the workpiece with respect to the interior edges 54 and 56 of the gauge. The thus aligned workpiece will be clamped between the upper clamp 48 and the lower clamps 42 and 44. In this regard, the various clamp elements will securely hold the workpiece around the periphery of the normal pattern 38.

Figure 3B:
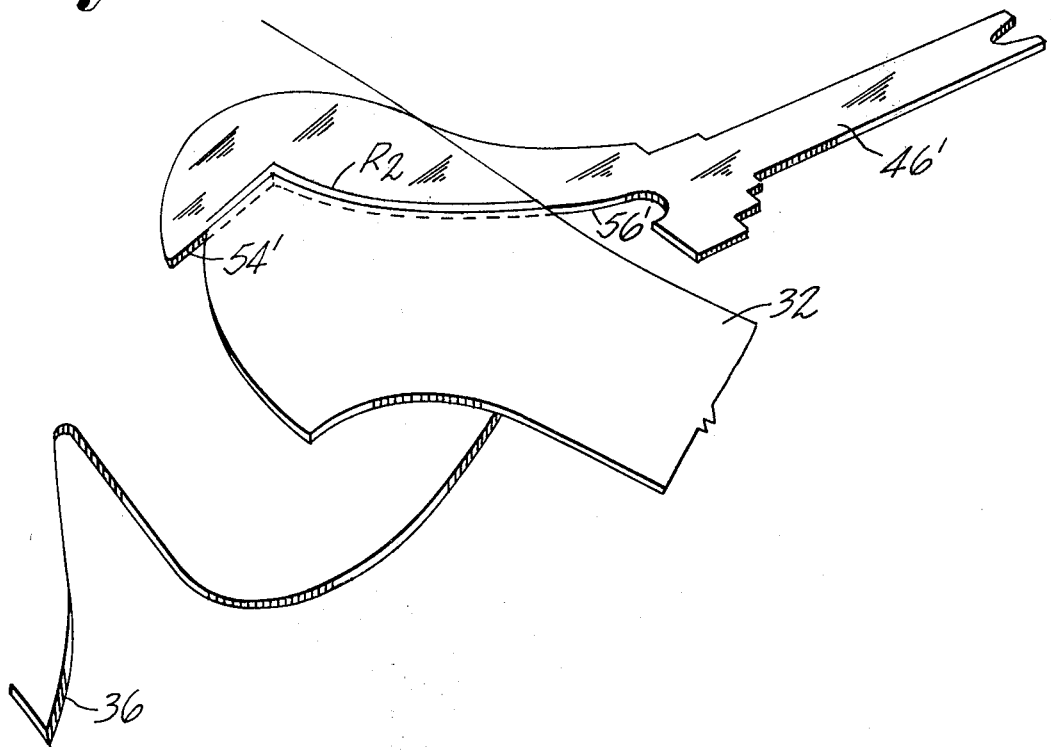
FIG. 3B illustrates an alternative clamp element to that illustrated in FIG. 3A.

The gauge 46 has been illustrated as being opaque in FIG. 3A. It is to be noted that the gauge 46 may be alternatively made of a transparent material such as clear plastic. Such a gauge is illustrated relative to the shoe quarter 32 and the shoe vamp 36 in FIG. 3B. The transparent gauge 46' in FIG. 3B allows one to view the shoe vamp 36 when the same is positioned underneath the gauge. This allows one to check the alignment of the shoe vamp 36 with respect to both the gauge 46' as well as the shoe quarter 32. It will be remembered that a line has been previously inscribed on the vamp 36 so as to align the edges 50 and 52 of the shoe quarter 32. If this line is detected underneath the transparent gauge 46', then the viewer will know that the vamp 36 is no longer in alignment with the shoe quarter 32. A still further preferred referencing for the purpose of confirming proper alignment of the shoe vamp 36 is illustrated in FIG. 3B. A second reference line R2 has been inscribed at a predefined distance from the first reference line (used to align the edges 50 and 52 of the shoe quarter 32). This second reference line should be clearly seen at all times through the transparent gauge 46'. If the second reference line R2 is askew or otherwise improperly spaced with respect to the edge 56', then the viewer will know that the shoe vamp is improperly aligned.

Figure 3C:
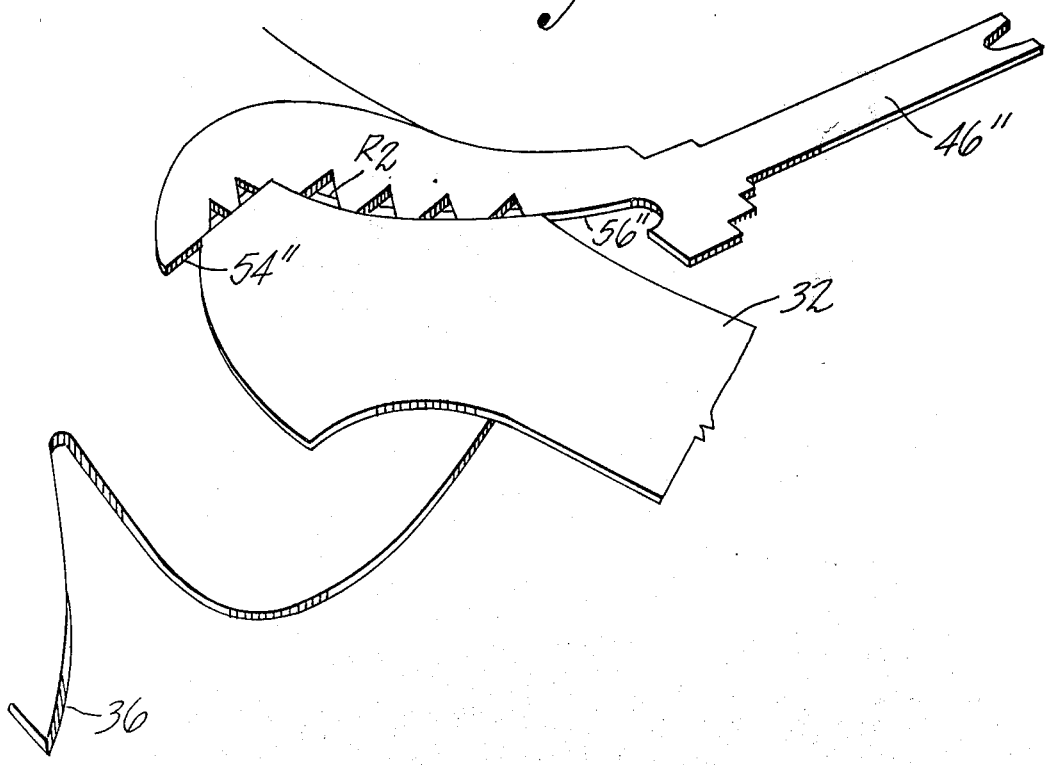
FIG. 3C illustrates another alternative clamp element to that illustrated in FIG. 3B.

A still further alternative to the gauge of FIG. 3A is illustrated in FIG. 3C. The gauge 46" in FIG. 3C is notched along the location edges 54" and 56" so as to reveal portions of the vamp 36. These exposed portions of the vamp 36 can be visually checked for presence of the reference line used to align the edges 52 and 54 of the shoe quarter 32. In the alternative, these exposed portions can be visually checked for the consistency of the reference line R2.

Figure 4:
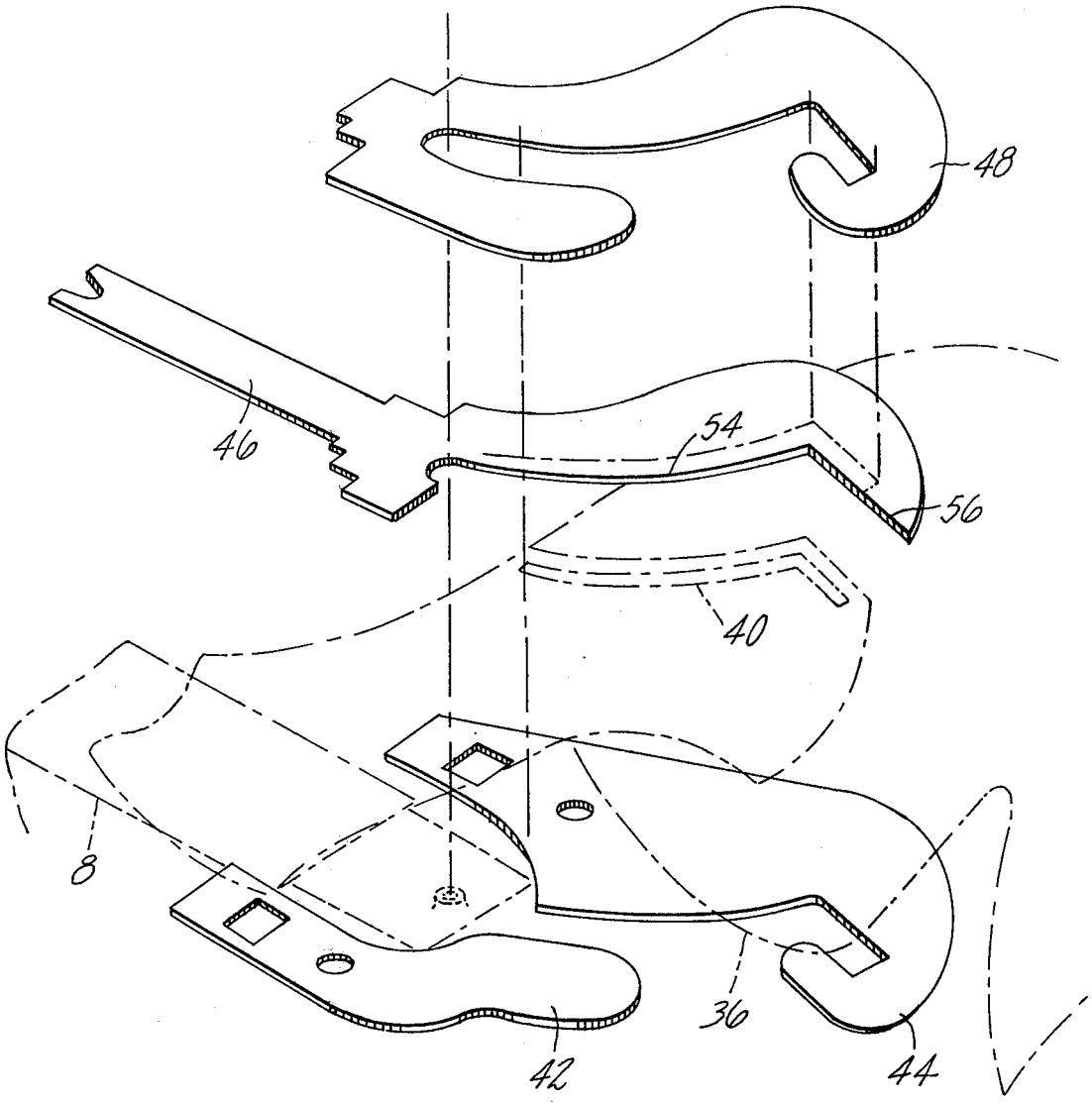
FIG. 4 is an exploded view of the clamp elements arranged in an alternate manner relative to the workpiece of FIG. 2.

It is to be appreciated that the clamp elements 42 through 48 of FIG. 3A (or their alternatives of FIGS. 3B and 3C) can be utilized to align and secure the shoe quarter 34 with respect to the shoe vamp 36. This is clearly illustrated in FIG. 4, wherein all clamp members have been turned over and the positions of the lower clamps 42 and 44 have been interchanged. The shoe quarter 34 (which has been previously aligned with respect to an inscribed line on the shoe vamp 36) is aligned with respect to the interior edges 54 and 56 of the gauge. The thus aligned workpiece consisting of the shoe quarter 34 and the shoe vamp 36 will be clamped between the upper and lower clamps so as to define an area for stitching the opposite pattern 40.

The aforementioned feature of utilizing one set of clamps to hold and secure different pieces of material for the sewing of different sewing patterns is premised on the ability to turn over the various clamps and interchange the positions of some of these clamps. This requires a carriage 10 which can receive these clamps in alternative ways.

Figure 5:
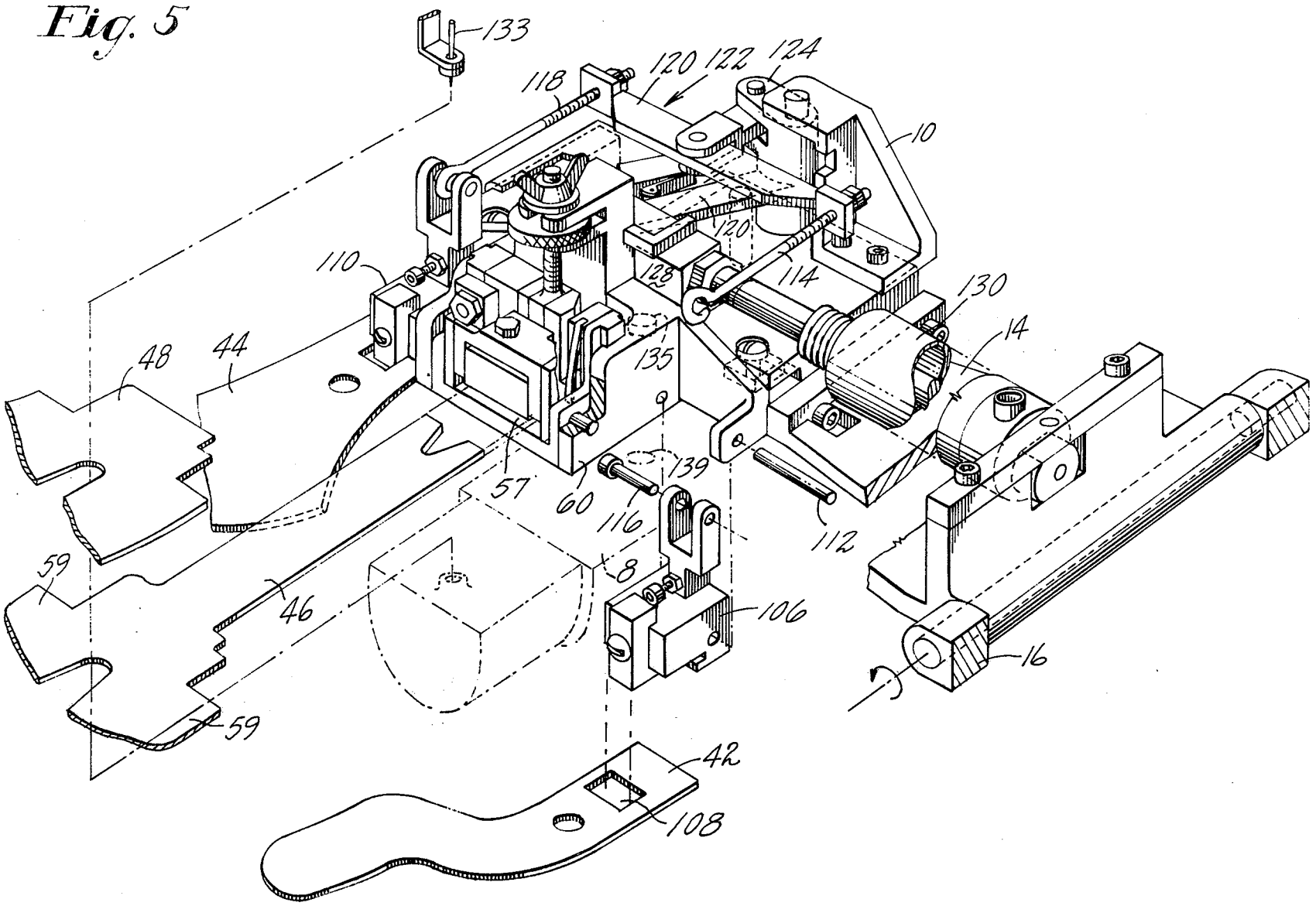
FIG. 5 is an illustration of how the clamp elements of FIG. 3A are inserted into the sewing machine of FIG. 1.

Referring now to FIG. 5, it is seen that the various clamps are inserted into the carriage 10. In particular, the gauge 46 and the upper clamp 48 are inserted into an opening 57 located at the front of the carriage 10. The gauge 46 is inserted into the opening 57 until its U-shaped end recess engages a location pin 58 located at the rear of the carriage 10. The location pin 58 assures the correct lateral positioning of the gauge 46. The gauge 46 is still further moved inwardly until its shoulders 59 engage the front facing to either side of the opening 57. The upper clamp 48 is similarly inserted into the opening 57 until its shoulders engage the facing to either side of the opening 57. The gauge 46 and the upper clamp 48 are secured within the opening 58 by a clamp-holding mechanism 60.

Figure 6:
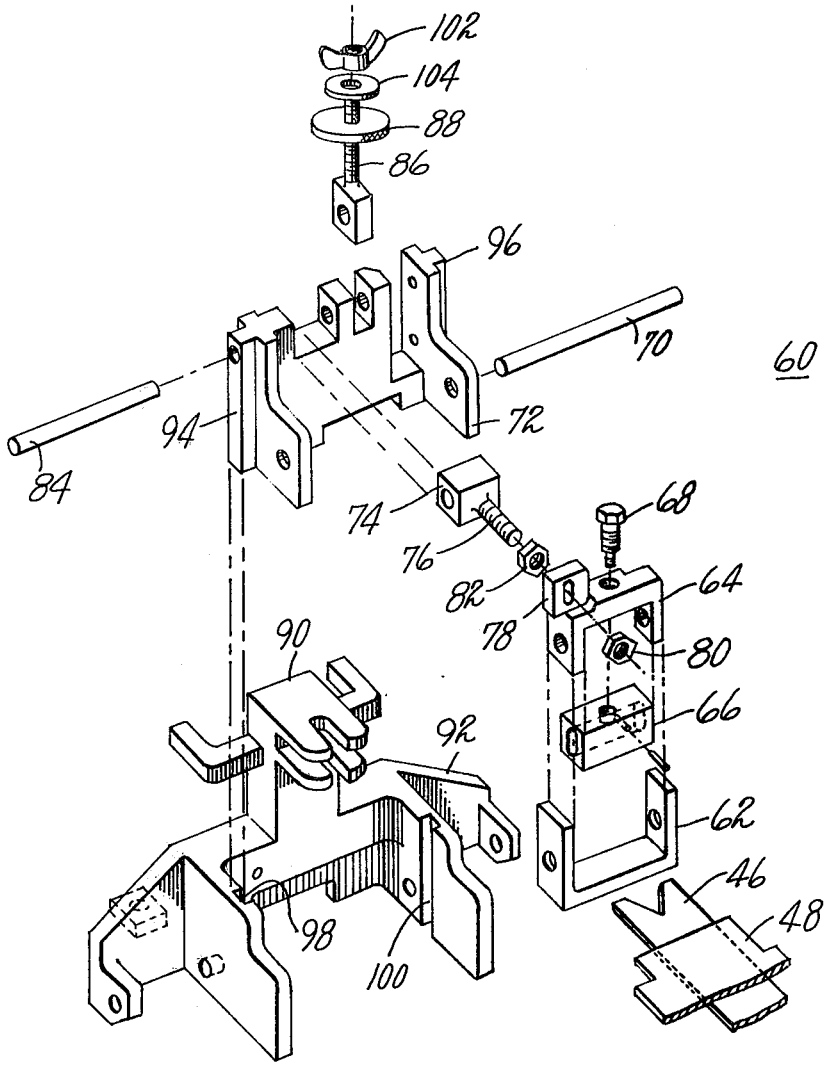
FIG. 6 is an exploded view of the various means within the sewing machine which receive and hold the clamp elements.

The elements comprising the clamp-holding mechanism 60 are illustrated in exploded fashion in FIG. 6. The elements which actually do the clamp holding comprise an upwardly extending bracket 62 which receives a downwardly extending bracket 64 plus a clamping block 66. The clamping block 66 moves relative to the brackets 62 and 64 by virtue of a clamp adjustment screw 68 which threadably engages the bracket 64. A narrowed diameter portion of the clamp adjustment screw inserts into the clamping block 66 whereas the larger diameter portion does not. The larger diameter portion bears downwardly on the clamping block 66 when the clamp adjustment screw 68 is appropriately rotated. This causes the clamping block 66 to in turn bear downwardly on the forward tongues of the upper clamp 48 and the gauge 46 which have been inserted thereunder.

The brackets 62 and 64 together with the clamping block 66 are pivotally mounted about a cylindrical insert 70 which inserts into a housing 72. The pivotal adjustment for the clamp-holding elements 62 through 66 comprise an adjustment block 74 having a threaded extension 76 which extends through an elongated hole in a shoulder 78 of the downwardly extending bracket 64. A pair of adjustment nuts 80 and 82 located at the front and rear of the shoulder 78 engage the threaded extension 76. Rotation of these adjustment nuts on the threaded extension 76 causes the clamp-holding elements 62 through 66 to pivot about the cylindrical insert 70. Since the clamp-holding elements 62 through 66 secure and hold the gauge 46 and the upper clamp 48, any pivotal adjustment of these elements will ultimately define the angular position of the gauge 46 and the upper clamp 48.

The adjusting block 74 is rotatably connected to the housing 72 by a cylindrical insert 84. The cylindrical insert 84 also serves as a mount for a height-adjustment member 86. The height-adjustment member 86 threadably engages a disc 88 which is mounted within a neck 90 of an exterior housing 92. A rotation of the thus mounted disc 88 will cause the height adjustment member 86 to move relative to the exterior housing 92. This will in turn cause the housing 72 (which is connected to the height adjustment member 86) to move relative to the exterior housing 92. This movement of the housing 72 is guided by a pair of vertical guides 94 and 96 which slidably engage a pair of channels 98 and 100 in the exterior housing 92. A particular height for the housing 72 relative to the exterior housing 92 is locked into place by rotating a wing nut 102 into contact with a washer 104 at the top of the neck 90. It is to be appreciated, that any such height which is thereby locked into place will also define a relative height of the upper clamp 48 and the gauge 46 with respect to the exterior housing 92.

From the foregoing, it is to be appreciated that the clamp-holding mechanism 60 is capable of defining both an angular position as well as a relative height for the gauge 46 and the clamp 48. This angular position and height will be maintained for any of a series of gauges 46 and upper clamps 48 which happen to be inserted and thereafter clamped within the clamp-holding mechanism.

Having described the insertion and securing of the gauge 46 and the upper clamp 48, it is now appropriate to turn to the insertion and securing of the lower clamps 42 and 44. Referring to FIG. 5, it is seen that the bottom clamp 42 is connected to a pivotal member 106. This particular connection is made by inserting the leading edge of the lower clamp 42 into a bottom recession in the pivotal member 106. The lower clamp 42 is locked into place by registering a rectangular slot 108 in the lower clamp with a downwardly extending portion of the pivotal member 106. In a similar fashion, the lower clamp 44 is connected to a pivotal member 110. It is to be understood that the clamps 42 and 44 may be turned over and interchanged with respect to the pivotal members 106 and 110. The interchanging of these members would not of course be necessary if they were joined together.

The pivotal member 106 is rotatably attached to the carriage 10 through a cylindrical insert 112. A similar rotatable mounting is provided for the pivotal member 110. The pivotal member 106 is furthermore rotatably connected to a linkage member 114 via a pin 116. A similar linkage 118 is rotatably connected to the pivotal member 110. The linkage members 114 and 118 are slidably connected to a yoke 120 which is in turn pivotally connected to a lever 122 of a bell crank 124. An arm 126 of the bell crank is pivotally connected to an extension 128 of an air-actuated piston within a cylinder 130. The cylinder 130 is mounted on the carriage arm 14 which is itself rotatably connected to the transport 16.

Figure 7:
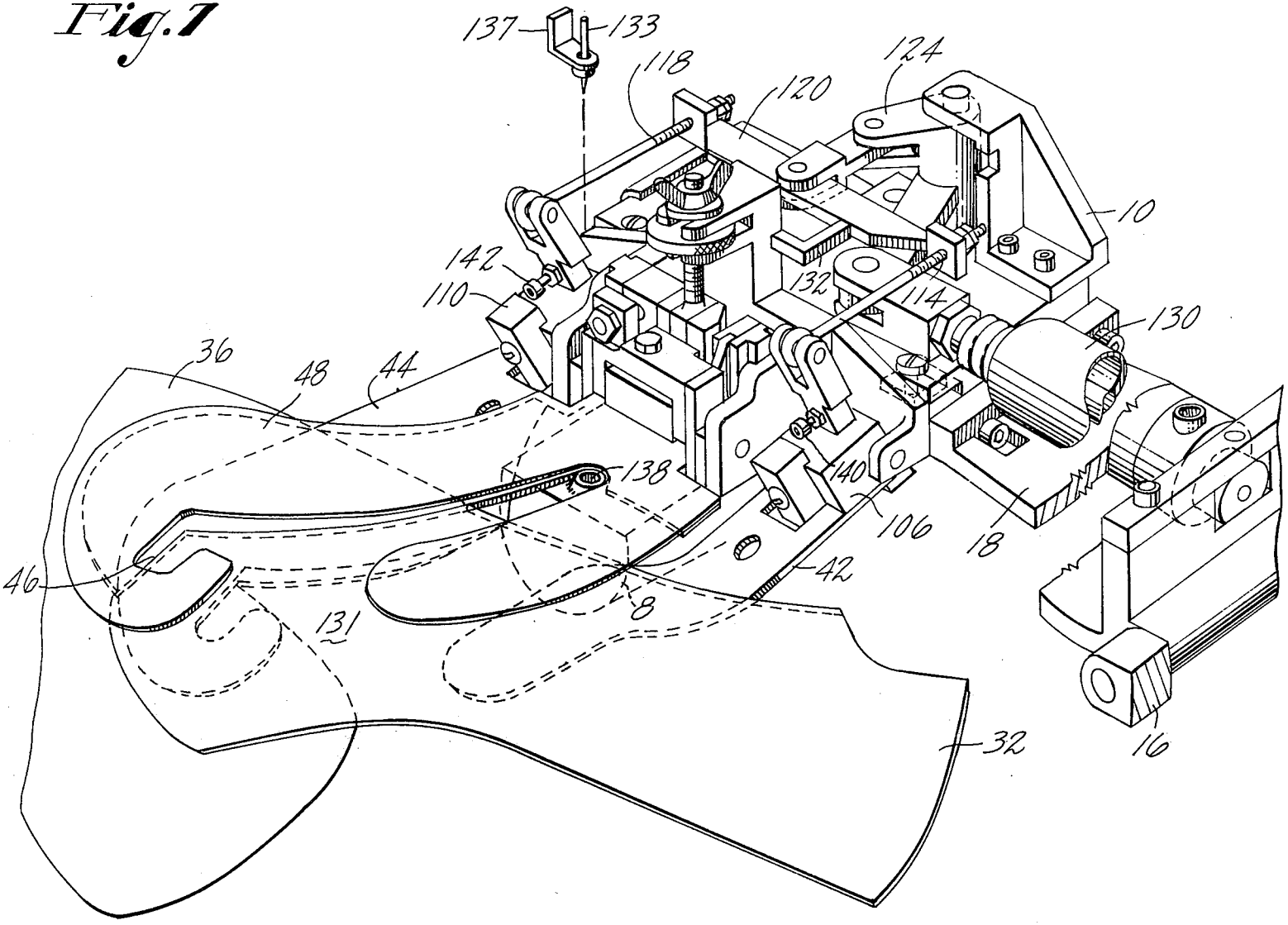
FIG. 7 illustrates the aligning of a workpiece with respect to the inserted clamp elements.

Referring to FIG. 7, the movement of the air-actuated piston within the cylinder 130 is illustrated. In particular, the air-actuated piston is shown in a fully retracted position. This has caused a counter-clockwise rotation of the bell crank 124 which in turn has caused the yoke 120 to move forward into contact with an abutment 132. The linkage arms 114 and 118 have moved outwardly with the yoke 120 so as to allow the pivotal members 106 and 110 to rotate downwardly. The downward position of the pivotal members constitutes an open clamp position which allows for either an insertion or removal of a workpiece.

FIG. 7 actually depicts the insertion of a workpiece into the opened clamps. The workpiece which is to be inserted consists of the shoe quarter 32 and the shoe vamp 36. Although not shown, the shoe quarter 32 may have already been joined to the shoe quarter 34 which in turn may have already been joined to the shoe vamp 36. If this is the case, then the workpiece will be three dimensional in nature when inserted into the open clamps. In any event, the workpiece is held between the operators thumb and first two fingers as it is inserted underneath the upper clamp 48. The upper clamp 48 (as well as all other clamps) provides an appreciable opening 131 for accommodating the operators thumb and fingers. This opening is defined by separately extending clamp portions which terminate along the same side of the stitching area.

It is to be noted that the clamp members extend outwardly over the end of the sewing bed 8. This outward extension of the clamp members is facilitated by the ball screw drive 18 of FIG. 1 which allows the movable carriage to be positioned out at the end of the sewing bed 8. This outermost position of the movable carriage is accomplished either manually or by the servo motor 26. The resulting outward extension of the clamp members allows the workpiece to be inserted as described above without encountering any interference with the sewing bed 8. This is particularly important for a three dimensional workpiece which will hang down below the clamps.

The actual alignment of the workpiece consists of positioning the forward edges of the shoe quarter 32 relative to the interior contour of the gauge 46. This has been previously discussed with regard to FIG. 3A. The operator may manually clamp the workpiece during this manipulation by rotating either one or both of the lower clamps 42 and 44 upwardly. In this regard, the lower clamps may be independently rotated upwardly by virtue of the slidable connection of the linkage members 114 and 118 with respect to the yoke 120.

Once the workpiece has been thus aligned to the operator's satisfaction, he or she can actuate a machine pressurized clamping of the workpiece. In this regard, the operator can cause a first air pressure to be applied to the piston within the cylinder 130. This causes the lower clamps 42 and 44 to pivot upwardly and clamp the workpiece at a relatively low clamping pressure. The workpiece can still be adjusted within the clamp area under this relatively low clamping pressure. After final adjustment of the workpiece, the operator causes a second pressure to be applied to the air-actuated piston within the cylinder 130 so as to produce a final clamping pressure on the workpiece. This final clamping line pressure is sufficient to hold the workpiece for the subsequent sewing operation.

The resultingly clamped workpiece is now to be positioned relative to the sewing needle 133. This is preferably accomplished by positioning the movable carriage 10 relative to a predefined location on the sewing bed 8. Referring to FIG. 5, an annular hole in the sewing bed 8 contains a normally recessed location pin 134. The location pin 134 can be moved upwardly into engagement with a location hole 135 in the bottom of the carriage 10. This positions the movable carriage and hence the clamped workpiece relative to the sewing needle 133.

Figure 8:
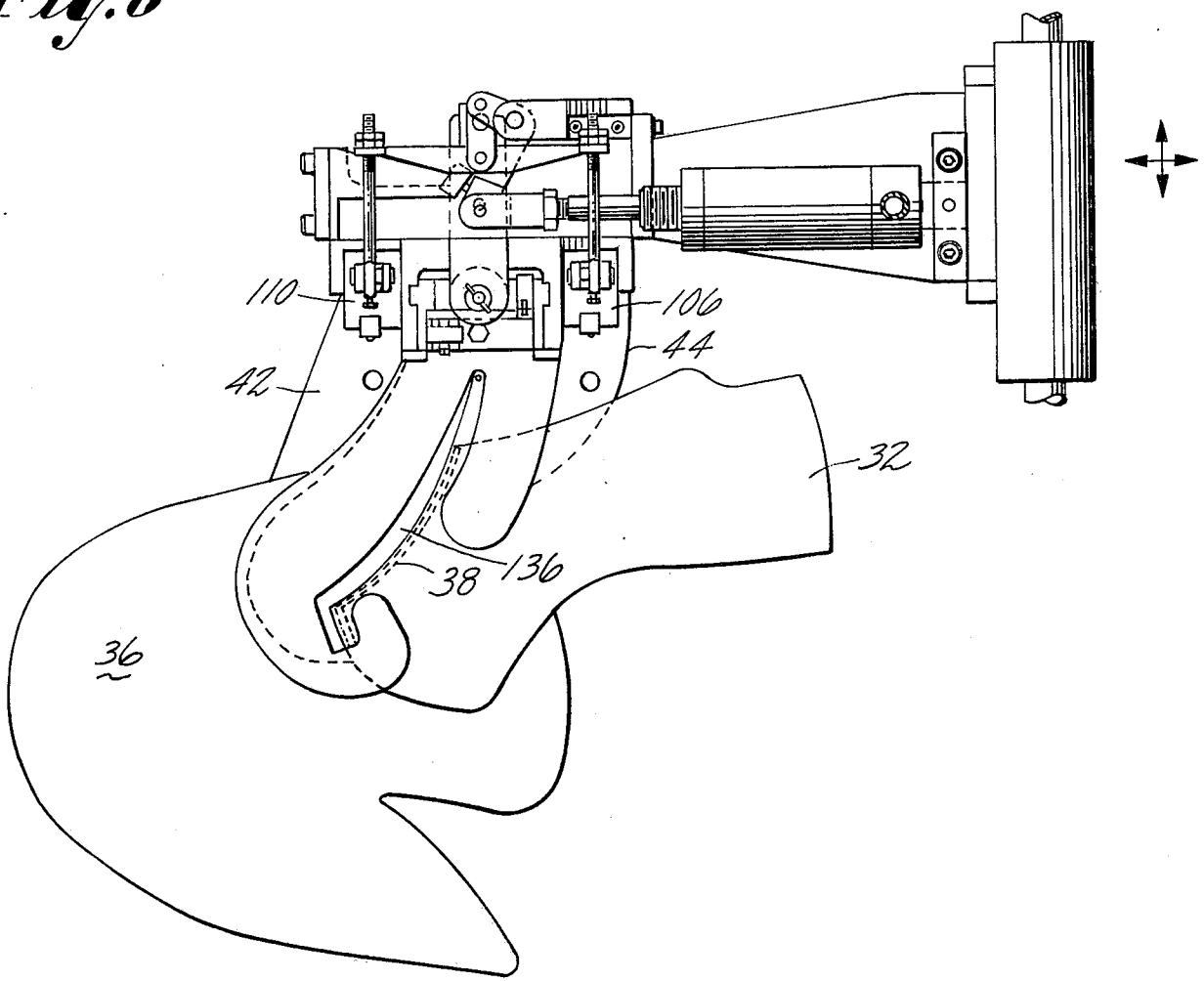
FIG. 8 is a view of the workpiece fully clamped within the sewing machine so as to permit stitching of a prescribed pattern in a given direction.

The clamped condition of a workpiece during a sewing operation is illustrated in FIG. 8. The workpiece is seen to be clamped in such a manner as to provide substantial clamping pressure around the periphery of the normal sewing pattern 38. This is accomplished by providing the upper and lower clamps with interior contours which substantially conform to the shape of the normal sewing pattern 38. The exception to this is in the area where the sewing pattern adjoins the interior contour of the gauge 46. The interior contour of the upper clamp 48 is recessed from the interior contour of the gauge 46 in this area. This exposes an area 136 on the gauge 46. The exposed area 136 allows one to check the alignment of the clamped workpiece when either a transparent or notched gauge has been used. It will be remembered from the discussions of FIGS. 3B and 3C that such gauges allow a person to check the position of one or more reference lines on the vamp which has been positioned underneath the gauge. The exposed area 136 also accommodates any portion of a presser foot associated with the sewing needle when the same is stitching close to the gauge. The latter will occur when the shoe quarter is stitched close to the edge that is aligned with respect to the interior contour of the gauge 46.

Figure 9:
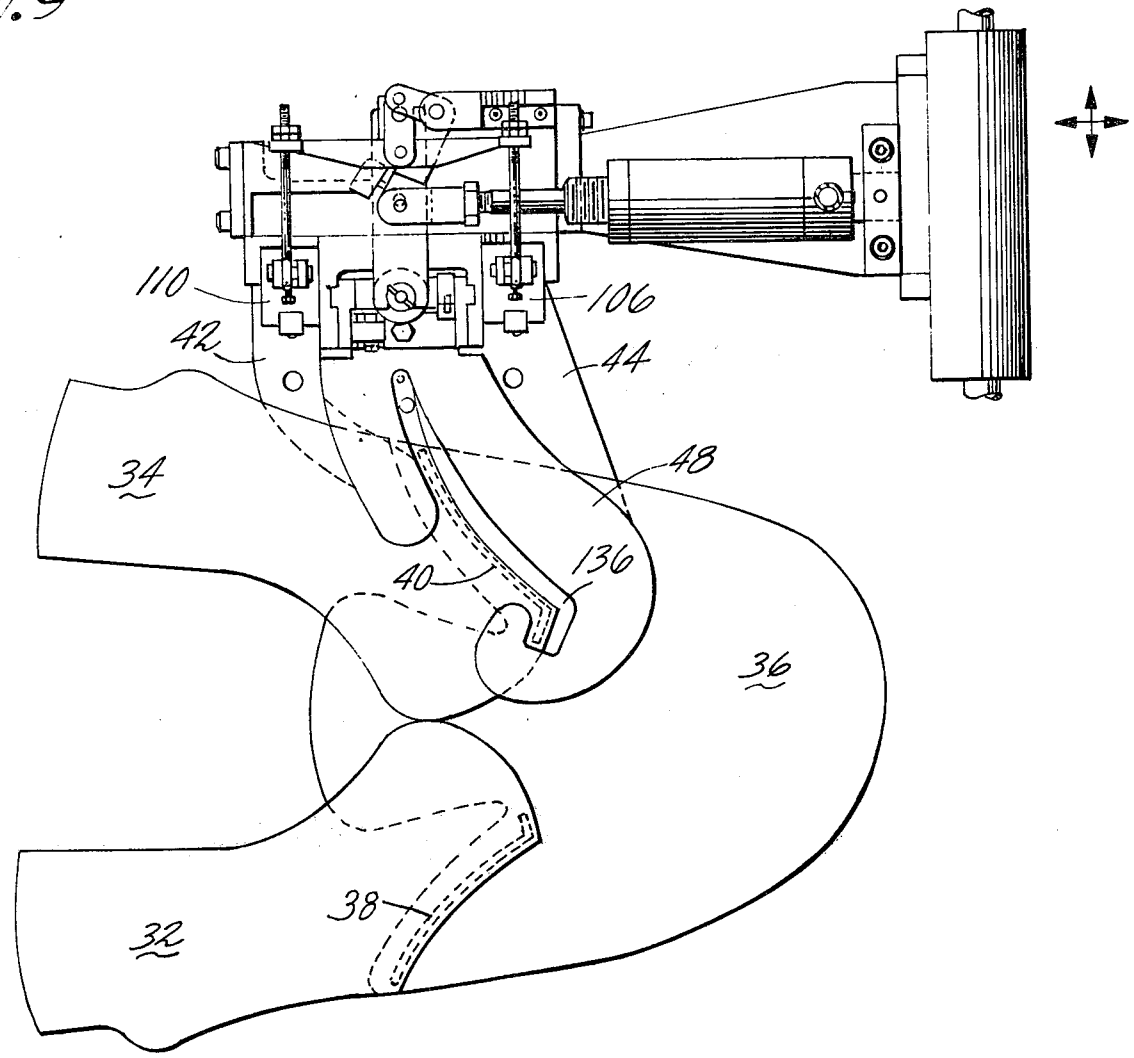
FIG. 9 is an illustration of the workpiece fully clamped within the sewing machine for stitching in the direction opposite to that of FIG. 8.

FIG. 9 depicts a workpiece which has been clamped for the sewing of the opposite sewing pattern 40. It is to be noted that all clamps have been turned over and that the lower clamp 42 is now attached to the pivotal member 110 and the lower clamp 44 is now attached to the pivotal member 106.

Figure 10:
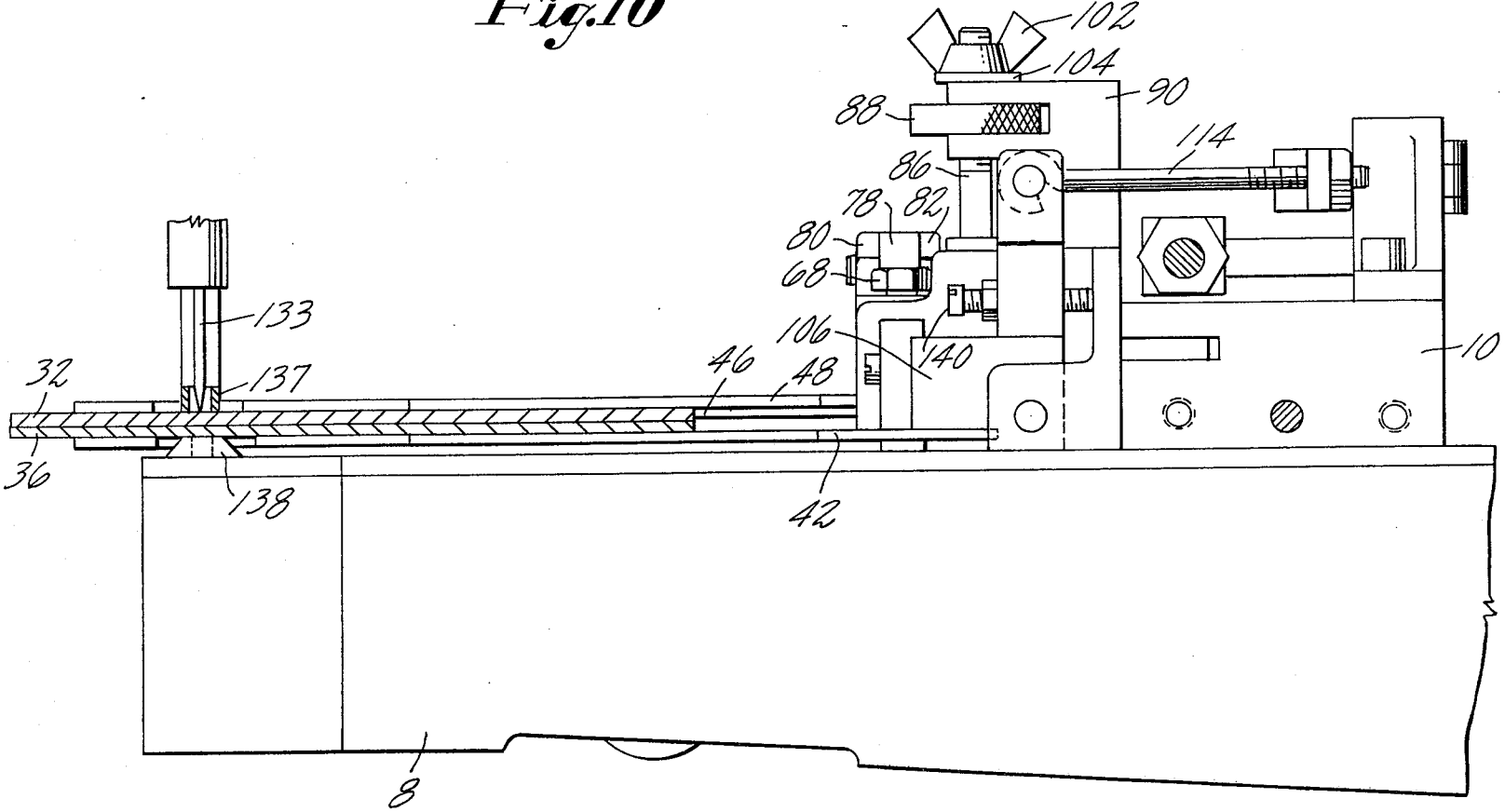
FIG. 10 illustrates the relative positions of the various clamp elements when the workpiece is positioned and securely clamped.

The clamped condition of the workpiece during a sewing operation is furthermore illustrated in FIG. 10. The workpiece consisting of the shoe portions 32 and 36 is sandwiched between the upper clamp 48 and the lower clamp 42. The sewing needle 133 and its presser foot 137 are positioned immediately above the shoe quarter 32. The presser foot 137 rests on the shoe quarter 32 as well as on the gauge 46 when the sewing is to take place near the edge of the shoe quarter. Regardless of where the stitching is to occur, the sewing needle 133 passes through the sandwiched workpiece and hence on into a throat 138. The workpiece is in continuous contact with the throat 138 by virtue of the height and parallel relationship of the lower clamps with respect to the bed 8 of the sewing machine. In this regard, the heights to the tops of both the lower clamps 42 and 44 are prearranged to be equal to the height of the throat 138. The parallel relationship of each lower clamp is individually established by adjustably rotating the pivotal member to which it is attached. In this regard, an adjusting screw 140 adjustably rotates the pivotal member 106 so as to thereby establish the parallel position of the lower clamp 42 with respect to the bed 8. In a similar manner, an adjusting screw 142 associated with the pivotal member 110 (as shown in FIG. 7) establishes the parallel position of the lower clamp 44 with respect to the bed 8. The thus levelled lower clamps will prevent flagging when the needle 133 engages the clamped workpiece.

It will be remembered from the discussion of FIG. 6 that the height and angular positions of the upper clamp 48 and the gauge 46 can also be set. These positions are set by adjustments within the clamp-holding mechanism 60. The height of the upper clamp 48 and the gauge 46 is established by rotating the disc 88. This allows the upper clamp 48 and the gauge 46 to accommodate various thicknesses of workpiece material. The angular position for both the upper clamp 48 and the gauge 46 is established by rotating the adjusting nuts 80 and 82. A slight angle of inclination of the upper clamp and gauge is sufficient to pinch the workpiece at the outermost extremity of these elements while at the same time not causing a loss of pressurized contact along the length of the workpiece which extends inwardly toward the carriage 10. The angle of inclination which assures such pressurized contact along the entire length of the clamped workpiece is in the range of 2°. This angle merely results in a slightly greater depression of the workpiece at the outermost edges of the upper clamp and gauges.

Figure 11:
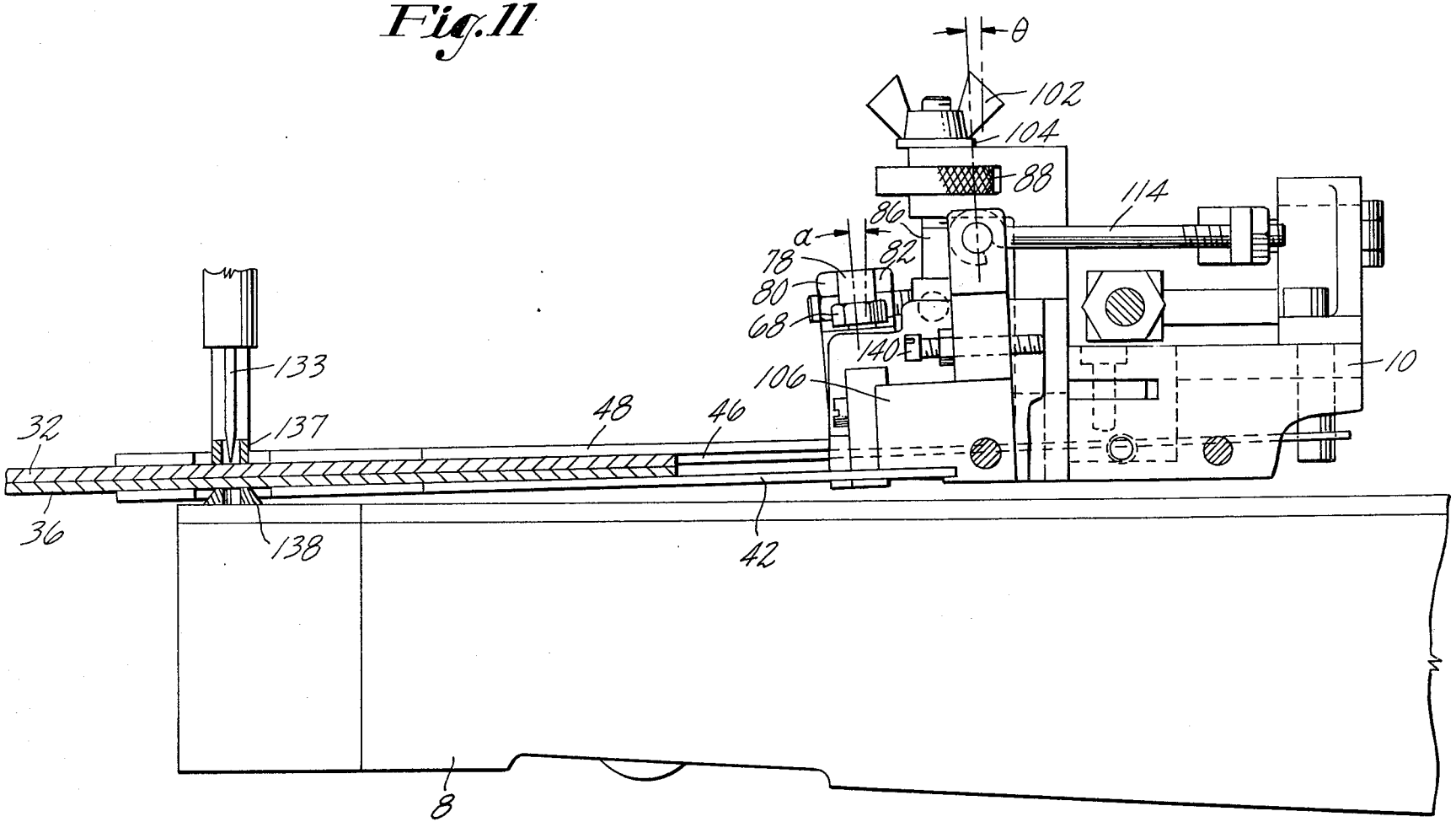
FIG. 11 illustrates an alternative positioning of the clamped workpiece within the automatic sewing machine.

Referring to FIG. 11, an alternative angular adjustment for the clamped workpiece is illustrated. Specifically, the adjusting screws 140 and 142 have been rotated so as to cause a marked angle of inclination for the lower clamps 42 and 44 with respect to the bed 8 of the automatic sewing machine. The degree of inclination is indicated by an angle Theta which marks the amount of rotation of the pivotal member 106. The angle of inclination Theta assures that the workpiece will always be in contact with the throat 138. It is to be noted that the angle of inclination Theta raises the entire carriage 10 off of the bed 8 of the automatic sewing machine. This raising of the carriage 10 is permitted by virtue of the carriage arm 14 being rotatably connected to the transport 16. This is particularly shown in FIGS. 1, 5 and 6. As a result of this pivotal or rotatable connection, the carriage 10 will rise and fall when moved relative to the throat 138.

It is to be noted that the inclination of the upper clamp 48 and the gauge 46 must also be established relative to the inclined lower clamps 42 and 44. This is accomplished by rotating the adjusting nuts 80 and 82 so as to rotate the clamp 48 and the gauge 46 downwardly by an angular amount Alpha. This angular amount is slightly greater than the angle Theta which establishes the inclination for the lower clamps. The difference in these angles results in a relative angle of inclination for the upper clamp 48 and the gauge 46 with respect to the lower clamps 42 and 44. This relative angle of inclination will assure continuous contact with the clamped workpiece beginning at the outermost point of the upper clamp 48 and the gauge 46.

Figure 12:
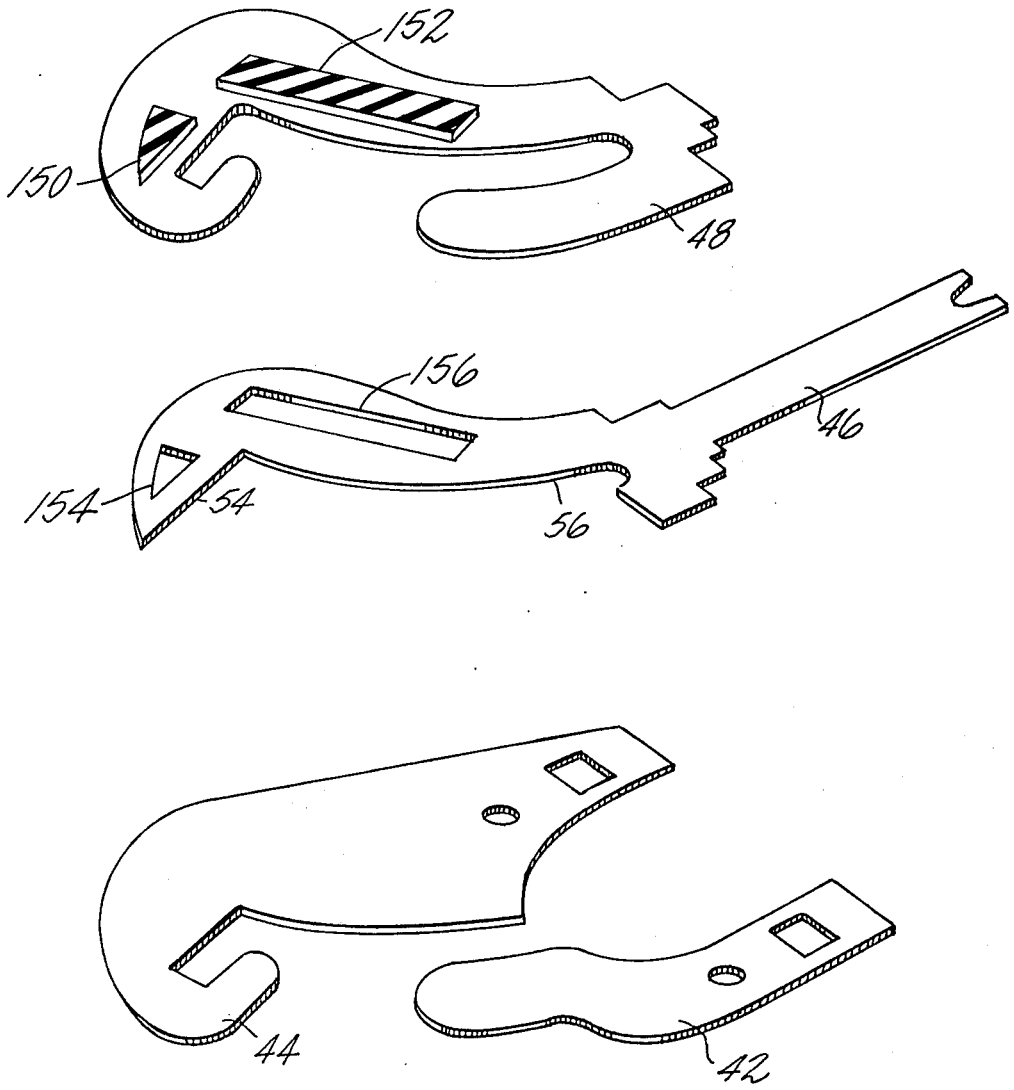
FIG. 12 illustrates an improvement with respect to the clamping elements of FIGS. 3A and 4.

FIG. 12 illustrates a still further improvement to the clamping capability of the clamp element 48. A plurality of friction surfaced mats 150 and 152 (consisting of rubber or other elastic material) are bonded to the top and bottom surfaces of the upper clamp element 48. Clearance slots 154 and 156 are provided in the gauge 46 so as accommodate these friction surfaced mats. The thicknesses of these friction surfaced mats are greater than the thickness of the gauge 46 so as to allow for a compression thereof when clamping pressure is applied to the workpiece. These compressed mats assure adequate localized holding of the workpiece at critical points such as at the outermost areas of the upper clamp element 48 and the gauge 46.

The localized holding at critical points can be even further enhanced by increasing the thickness of the mats at critical points. For instance, it may be necessary to increase the thickness of mat 150 over that of mat 152 so as to correct for any outer separation of the upper clamp element 48 with respect to the lower clamp element. On the other hand, it may be necessary to do exactly the opposite if the upper clamp element has been inclined relative to the lower clamp elements as is disclosed in FIGS. 10 and 11. It is to be noted that these mats may also be bonded to various portions of the lower clamping elements to provide a similar compressed gripping or holding of the workpiece.

From the foregoing, it is to be appreciated that a preferred embodiment has been disclosed for an apparatus which holds a workpiece during a sewing operation. It is to be appreciated that alternative structure may be substituted for elements of the preferred embodiment without departing from the scope of the present invention.

What is claimed is:

1. Apparatus for securely clamping a workpiece which is to be transported with respect to the sewing head of a sewing machine, said apparatus comprising:

a plurality of clamping means for clamping a workpiece, said plurality of clamping means having at least two clamping configurations wherein each clamping means is turned over between the first clamping configuration and the second clamping configuration;

means for holding said plurality of clamping means in the various different clamping configurations so that each of said clamping means freely extends outwardly therefrom; and means for moving said holding means relative to the sewing head so as to successively position a workpiece that has been clamped by said plurality of outwardly extending clamping means.

2. The apparatus of claim 1 wherein said plurality of clamping means comprises:

first clamping means for aligning the workpiece;

second clamping means positioned above said first clamping means for applying downward clamping pressure on the aligned workpiece; and third clamping means positioned beneath said first clamping means for applying upward clamping pressure on the aligned workpiece.

3. The apparatus of claim 2 wherein there are two basic clamping configurations and the first, second, and third clamping means are each turned over when switching from the first basic clamping configuration to the second basic clamping configuration.

4. The apparatus of claim 3 wherein said means for holding said plurality of clamping means comprises:

means for receiving portions of said first and second clamping means;

means for rotatably supporting said means for receiving portions of said first and second clamping means; and means for rotating said means for receiving portions of said first and second clamping means so as to establish an angular position of said first and second clamping means.

5. The apparatus of claim 4 wherein said means for receiving said first and second clamping means further comprises:

means for moving said rotatable support means vertically so as to define a vertical position for said first and second clamping means.

6. The apparatus of claim 5 wherein said means for moving said rotatable support means vertically comprises:

means for housing said rotatable support means, said housing means having vertical guides for guiding said rotatable support means; and means, mounted on said housing means, and rotatably attached to said rotatable support means, for vertically moving said rotatable support means relative to said housing means.

7. The apparatus of claim 3 wherein said holding means further comprises:

means, pivotally mounted to said means for receiving portions of said first and second clamping means, for receiving said third clamping means; and means for rotating said pivotal mounting means which receives said third clamping means, the rotation being such as to displace said third clamping means relative to said first and second clamping means.

8. The apparatus of claim 7 wherein said means for rotating said pivotal mounting means comprises:

actuator means for applying at least two clamping pressures to the workpiece through said third clamping means, the first clamping pressure being such as to allow further movement of the clamped workpiece, the second clamping pressure being sufficient to prevent movement of the clamped workpiece during sewing.

9. The apparatus of claim 7 further comprising:

means for slidably connecting said pivotal mounting means to said rotating means, said slidable connection allowing said pivotal mounting means to be rotated in a manual fashion.

10. The apparatus of claim 2 wherein said third clamping means comprises two separate clamping means and said holding means comprises:

a pair of means for receiving said two separate clamping means, each of said receiving means being pivotally mounted within said holding means; and means for rotating said pair of means for receiving said two separate clamping means, the rotation being such as to displace said two separate clamping means relative to said first and second clamping means.

11. The apparatus of claim 10 further comprising:

means for slidably connecting said pair of receiving means to said rotating means, said slidable connection allowing said pair of receiving means to be individually rotated in a manual fashion.

12. The apparatus of claim 2 wherein said third clamping means is displaced from an open to a closed position relative to said first and second clamping means, the closed position resulting in the clamping of a workpiece which has been previously aligned with respect to said first clamping means.

13. The apparatus of claim 12 further comprising:

means for adjustably defining the closed position of said third clamping means relative to the bed of said sewing machine.

14. The apparatus of claim 13 wherein said holding means is pivotally connected to said means for moving said holding means, said holding means being free to move in an arc defined by said pivotal connection.

15. The apparatus of claim 1 wherein said holding means is pivotally connected to said means for moving said holding means, said holding means being free to move in an arc defined by said pivotal connection.

16. The apparatus of claim 15 wherein said holding means comprises:

means for inclining said plurality of clamping means relative to the sewing bed of the sewing machine so that a clamped workpiece is inclined downwardly from said holding means causing the clamped workpiece to rest on the sewing needle throat located on the sewing bed, the inclined workpiece thereby supporting said holding means which is otherwise only pivotally connected to said means for moving said holding means.

17. The apparatus of claim 2 wherein said second and third clamping means have opposing surfaces that clamp the workpiece therebetween and wherein at least one of said opposing surfaces has at least one compressible pad located thereon.

18. The apparatus of claim 17 wherein said first clamping means has at least one opening therein for accommodating said compressible pad, so that a said compressible pad extends therethrough when clamping pressure is applied to the workpiece.

19. The apparatus of claim 18 wherein said compressible pad and said opening are located at the outermost end of said first and second clamping means.

20. The apparatus of claim 1 wherein said means for moving said holding means comprises:

means for positioning said holding means at an outermost position relative to the bed of the sewing machine so that said plurality of clamping means extend outwardly over the end of the bed of the sewing machine.

21. The apparatus of claim 20 wherein said plurality of clamping means comprises:

first clamping means for aligning the workpiece;

second clamping means positioned above said first clamping means for applying downward clamping pressure on the aligned workpiece; and third clamping means positioned beneath said first clamping means for applying upward clamping pressure on the aligned workpiece.

22. The apparatus of claim 21 wherein said third clamping means is pivotally attached to said holding means so as to rotate downwardly when a workpiece is to be inserted and aligned with respect to said first clamping means.

23. The apparatus of claim 2 wherein said first clamping means is transparent so as to allow a viewing of that portion of the aligned workpiece positioned thereunder.

24. The apparatus of claim 2 wherein said first clamping means has at least one edge for aligning the workpiece, said edge being notched so as to allow a viewing of a portion of the aligned workpiece positioned thereunder.

25. The apparatus of claim 1 further comprising:

a location hole in said means for holding said plurality of clamps; and a retractable location pin normally recessed in the sewing bed of said sewing machine, said location pin being movable upwardly into engagement with the location hole in said means for holding said plurality of clamps.

26. Apparatus for securely holding a workpiece consisting of at least two pieces of material which are to be joined together, said apparatus comprising:

first means for aligning the edge of at least one of the pieces of material constituting the workpiece;

second means, positioned above said first means, for applying downward clamping pressure on the workpiece;

third means positioned beneath said first means for applying upward pressure on the workpiece;

means for receiving portions of both said first and second means;

means for rotatably supporting said means for receiving said first and second means; and means for rotating said means for receiving said first and second means so as to establish an angular position of said first and second means with respect to said third means.

27. The apparatus of claim 26 further comprising:
means for moving said rotatable support means vertically so as to define a vertical position of said first and second means relative to said third means.

28. The apparatus of claim 27 wherein said means for moving said rotatable support means vertically comprises:
means for housing said rotatable support means, said housing means having vertical guides for guiding said rotatable support means; and
means, mounted on said housing means, and rotatably attached to said rotatable support means, for vertically moving said rotatable support means relative to said housing means.

29. The apparatus of claim 26 further comprising:
means for pivoting said third means relative to said first and second means; and
means for limiting the pivoting of said third means so as to define an angular position of said third means relative to said first and second means.

30. Apparatus for holding and securing a workpiece having at least two different sewing patterns which are to be sewn, said apparatus comprising:
first means for aligning the workpiece for the sewing of a first pattern and for alternatively aligning the workpiece for the sewing of a second pattern, the alternative alignment for the second pattern being premised on turning over said first means;
second means, positioned above said first means for applying downward pressure on the workpiece when aligned for the sewing of a first pattern, said second means being turned over so as to apply downward pressure on the workpiece when aligned for the sewing of the second pattern; and
third means, positioned below said first means, for applying upward pressure on the workpiece when aligned for the sewing of a first pattern, said third means being turned over so as to apply upward pressure on the workpiece when aligned for the sewing of the second pattern.

31. The apparatus of claim 30 wherein said first means comprises:
an elongated member having an edge which conforms to a first portion of the workpiece when oriented relative thereto, said edge conforming to a different portion of the workpiece when said elongated member is turned completely over and the different portion of the workpiece is oriented relative thereto.

32. The apparatus of claim 31 wherein said elongated member is transparent so as to allow a viewing of a portion of the aligned workpiece positioned thereunder.

33. The apparatus of claim 32 wherein said second means has an interior edge which is recessed relative to the edge of said elongated member so as to allow a viewing of a portion of the aligned workpiece positioned under said elongated member.

34. The apparatus of claim 31 wherein said edge of said elongated member is notched so as to allow a viewing of a portion of the aligned workpiece positioned thereunder.

35. The apparatus of claim 34 wherein said second means has an interior edge which is recessed relative to the edge of said elongated member so as to allow a viewing of a portion of the aligned workpiece positioned under said elongated member.

36. The apparatus of claim 30 wherein the workpiece comprises a shoe upper consisting of a vamp portion plus first and second quarter portions and wherein said first means comprises:
an elongated member having an edge guide which conforms to at least one edge of the first quarter portion when oriented relative thereto, said edge guide conforming to at least one edge of the second quarter when said elongated member is turned over and oriented relative thereto.

37. The apparatus of claim 36 wherein the two quarter portions are joined together so that the workpiece consists of a vamp portion and two previously joined together shoe quarter portions.

38. The apparatus of claim 26 further comprising:
means for mounting said first, second and third means;
means for moving said mounting means in a predefined manner so as to present the clamped workpiece to a sewing needle in a manner which allows for the sewing of a particular sewing pattern.

39. The apparatus of claim 30 wherein the second pattern is a mirror image of the first pattern.

40. The apparatus of claim 30 wherein the first and second patterns are vamp stitch patterns and wherein the workpiece comprises shoe quarters which are to be joined to a shoe vamp.

* * * * *

UNITED STATES PATENT OFFICE

CERTIFICATE OF CORRECTION

Patent No. 4,171,672 Dated October 23, 1979

Inventor(s) Dorosz, Malecki, Martin, Johnson and Wickers

It is certified that error appears in the above-identified patent and that said Letters Patent are hereby corrected as shown below:

Claim 38 -

Line 1: Delete "26" and insert --36--.

Signed and Sealed this

*Fifth* Day of *February 1980*

[SEAL]

*Attest:*

SIDNEY A. DIAMOND

*Attesting Officer*

*Commissioner of Patents and Trademarks*